United States Patent [19]

Assmann

[11] 4,383,470

[45] May 17, 1983

[54] PROCESS FOR MANUFACTURING A SMALL FIRING TUBE OPENED AT THE TWO ENDS THEREOF FOR A HAND GRENADE FUSE

[75] Inventor: Hans Assmann, Schwanenstadt, Austria

[73] Assignee: Oregon Etablissement für Patentverwerting, Liechtenstein

[21] Appl. No.: 253,520

[22] PCT Filed: Jul. 17, 1980

[86] PCT No.: PCT/EP80/00060

§ 371 Date: Apr. 1, 1981

§ 102(e) Date: Mar. 31, 1981

[87] PCT Pub. No.: WO81/00450

PCT Pub. Date: Feb. 19, 1981

[30] Foreign Application Priority Data

Aug. 1, 1979 [AT] Austria ..... 5273/79

[51] Int. Cl.[3] ..... C06D 1/08

[52] U.S. Cl. ..... 86/20 R; 86/1 R; 86/23; 102/487

[58] Field of Search ..... 86/20 R, 1, 23; 102/487

[56] References Cited

U.S. PATENT DOCUMENTS 3,952,628 4/1976 Boswell ..... 86/20 R 4,127,054 11/1978 Gully ..... 86/23

*Primary Examiner*—Stephen J. Lechert, Jr.

*Attorney, Agent, or Firm*—McGlew and Tuttle

[57] ABSTRACT

A delay charge is filled into a tubular delay charge carrier closed on one end, and the filling height is measured subsequently. Only when the sufficient filling height of the delay charge has been reached, the bottom part of said tubular delay charge carrier is provided with an aperture so that only then the detonating charge of the hand grenade fuze can be ignited.

2 Claims, 5 Drawing Figures

PROCESS FOR MANUFACTURING A SMALL FIRING TUBE OPENED AT THE TWO ENDS THEREOF FOR A HAND GRENADE FUSE

BACKGROUND OF THE INVENTION

1. Field of the Invention

The present invention relates to a method for producing a tubular delay charge carrier for a hand grenade fuze, said carrier being open on both sides, a detonating charge being only ignited if a delay charge is contained in said tubular delay charge carrier.

2. Description of the Prior Art

In order to eliminate any danger to the thrower, the delay charge in the delay charge carrier effects a delayed detonation, when the hand grenade has already been projected, the safety lever being thrown off and the primer is struck during projection. After the burning of the delay charge, a flash of flame exits from the open carrier end and initiates the detonating charge (e.g. in accordance with the U.S. Pat. No. 2,562,928). It may happen in mass production, in particular, that the delay charge carrier has not or insufficiently been filled with the delay charge. The flash of flame emitted from the primer immediately hits the detonating charge in the first case so that the hand grenade detonates immediately, when being projected. The delay charge detonates in the second case but the delay is too short and the hand grenade detonates, when still flying.

In order to obviate the immediate detonation of a hand grenade, i.e. when a delay charge is not provided, the AT-PS No. 335.314 provides a safety disk sealing the delay charge carrier towards the detonating charge, said disk being dimensioned in such a manner that it melts only if the lowest part of the delay charge is ignited. It does not melt, however, when no delay charge has been provided, and the flash of flame from the primer hits the safety disk. Hence, the ignition of the detonating charge depends on the characteristics of the disk material, when a detonating charge has been provided. There remains, however, the problem of the incompletely filled delay charge carrier in which the amount of delay charge is insufficient, and consequently the delay time is too short.

SUMMARY OF THE INVENTION

It is, therefore, the object of the present invention to provide a method for producing a faultless tubular delay charge carrier in which the ignition of the detonating charge is not directly initiated by the ignition flash of the primer but exclusively by the delay charge. This depends on the charge but also on the correct filling height of the delay charge.

In accordance with the present invention, this is achieved by filling the delay charge into a tubular delay charge carrier closed on one side and by subsequently measuring the filling height, whereupon the bottom part of the delay charge carrier is perforated but only when the filling height of the delay charge is sufficient.

The method in accordance with the present invention does, therefore, not provide a safety member, as described in the beginning in order to make a possible lack of the delay charge ineffective, but the operating cycle following immediately to the filling process, i.e. perforating the bottom part of the delay charge carrier, is dependent on the presence of the delay charge. It is a particularly advantageous and important effect of the present invention that the bottom part will not be perforated if the delay charge does not reach the set filling height. As the delay charge generally comprises a number of layers, the lack of a layer as well as an insufficient compression of the layers will be recognized. The deficiently filled delay charge carriers can be immediately excluded from the operating cycle. They can, however, remain in the operating cycle, when delay charge carriers have been employed comprising a bottom part which is not melted by the flash of flame resp. gas jet of the delay charge. Even when a partially filled delay charge carrier is completed to a hand grenade fuze and inserted into a hand grenade, the hand grenade will not detonate while being projected.

A preferred embodiment provides that after filling the delay charge into the tubular delay charge carrier, a control piston is inserted into said tubular carrier until reaching the desired filling height and a punch is arranged at the bottom part of said carrier, whereupon the distance between the control piston and the punch is reduced. Depending on the actual filling height, the tubular delay charge carrier is either pushed onto the punch, thereby perforating said bottom part, or pushed further onto the control piston.

BRIEF DESCRIPTION OF THE DRAWING

In the following the method in accordance with the present invention will be described in greater detail by means of the figures of the drawing without being limited thereto.

DESCRIPTION OF THE PREFERRED EMBODIMENTS

Figure 1:
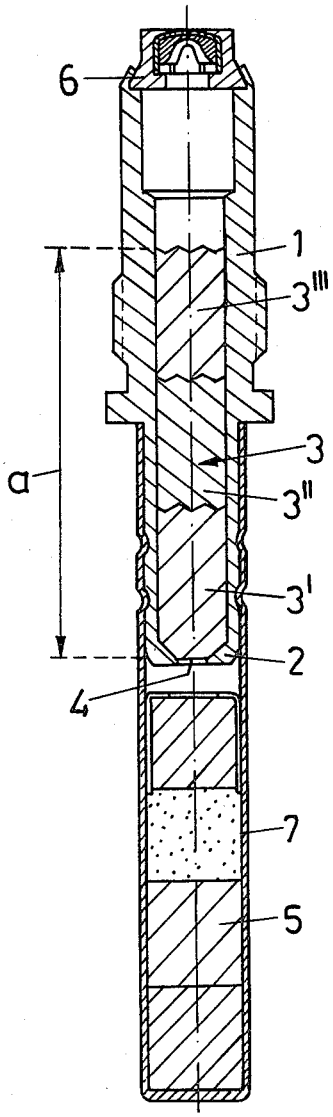
FIG. 1 shows a longitudinal sectional view of a hand grenade fuze.

A hand grenade fuze (FIG. 1) comprises a tubular delay charge carrier 1 containing the delay charge 3 filled into said carrier in three layers 3', 3'', 3''', for example. Said carrier 1 is open on both sides, a primer 6 being arranged at its upper end. The second end of the tubular delay charge carrier 1 has an aperture 4 in the bottom part 2. A supporting tube 7 for a detonating charge 5 is attached to said second end. After igniting the primer by means of the striker, the flash of flame ignites the delay charge 3, which fills the carrier up to a height a guaranteeing sufficient delay. After the burning of the delay charge 3, the detonating charge 5 is ignited by the flash of flame exiting from the aperture 4. If there is no delay charge 3, the flash of flame of the primer 6 hits directly the detonating charge 5, and the hand grenade detonates immediately; if the delay charge 3 does not reach the correct filling height a, the delay will be too short, and the hand grenade detonates in the air during projection. Both possibilities should be obviated as far as possible.

Figure 2:
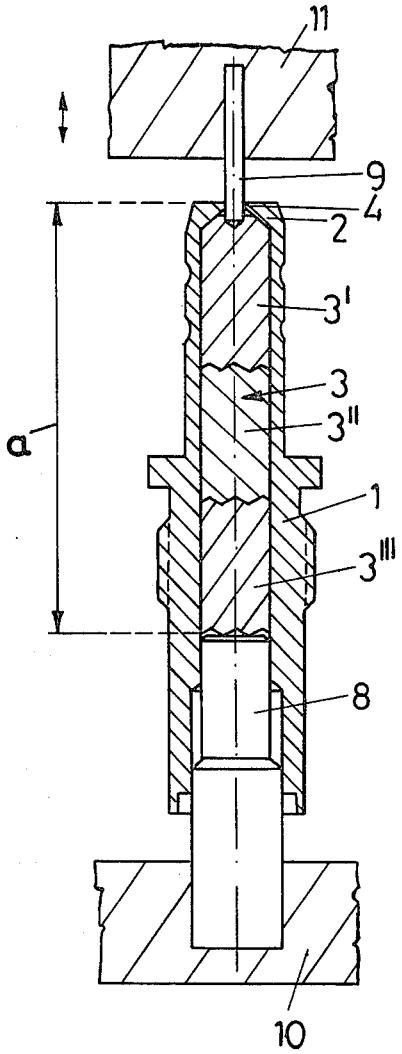
FIG. 2 shows the punching process of a tubular delay charge carrier in accordance with the present invention, which has been filled up to the desired height.
Figure 5:
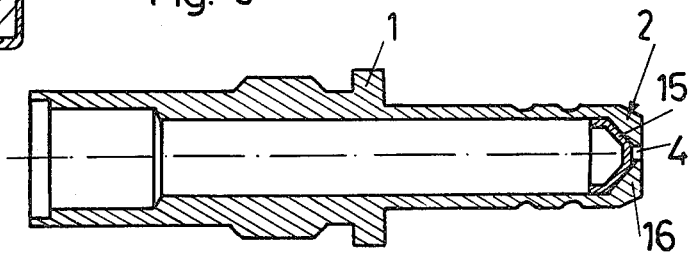
FIGS. 4 and 5 shows two further embodiments of a tubular delay charge carrier closed on one end for being employed in the method in accordance with the present invention.
Figure 3:
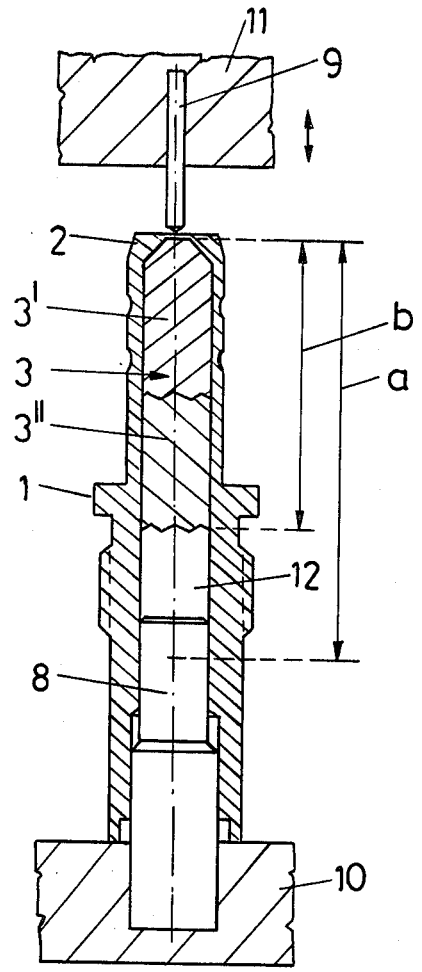
FIG. 3 shows the corresponding operating cycle, when the desired filling height has not been reached.
Figure 4:
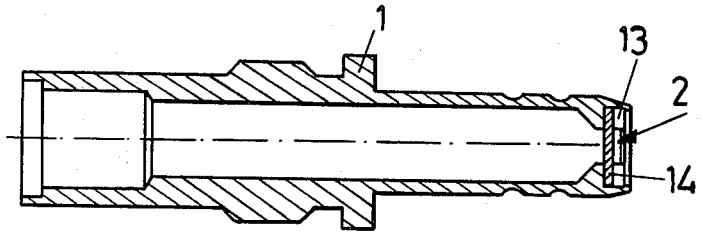

In accordance with the method of the present invention, the bottom part 2 is punched, i.e. the aperture 4 is made, only if the correct amount of delay charge 3 has been filled into the carrier, i.e. if, in accordance with this embodiment, all layers 3', 3'', 3''' are contained in the tubular delay charge carrier 1 (FIG. 2). As illustrated in FIGS. 1 through 3, the tubular delay charge carrier 1, which is closed on one end, can, for example, comprise an integrated bottom part 2; a bottom member forming said bottom part 2 can, however, also be inserted afterwards. FIGS. 4 and 5, for example, show a tubular delay charge carrier of this kind. As shown in FIG. 4, said bottom part 2 is formed by a disk 14 retained by a flanged safety ring 13. FIG. 5 shows a tubular delay charge carrier 1 with an aperture 4 on the side of the detonating charge, said aperture being closed by a cup-like insert 15 prior to filling the delay charge 3 into the delay charge carrier, said insert propping against the wall portion 16 of the delay charge carrier 1 surrounding the aperture 4, the thickness of said wall portion increasing towards the interior.

After the actual or believed filling process, the tubular delay charge carrier 1 is positioned on a control piston 8 arranged on a base 10, whereby said piston enters into said carrier 1 until reaching the desired filling height a. A punch 9 projecting the lowerable upper member 11 is placed against the bottom part 2 of said carrier and finally moved further downwards so that the distance between the control piston 8 and the punch 9 is reduced. When the delay charge 3 has the correct filling height a (FIG. 2), it acts as an extension of the control piston 8, i.e. the punch 9 pushes through the bottom part 2 resp. through the disk 14 or the insert 15, whereby forming the aperture 4.

If, however, as illustrated in FIG. 3, the amount of the delay charge 3 filled into the delay charge carrier is insufficient, its filling height being b only, the reduction of the distance between the control piston 8 and the punch 9 effects that the bottom part 2 is not punched. This is due to the fact that the carrier 1 is pushed further onto the control piston 8 as there is a hollow space 12 between said piston and the delay charge.

It is now possible to exclude deficient delay charge carriers from the operating cycle. In order to avoid an interruption of the operating cycle, they can also be completed to hand grenade fuzes and inserted into hand grenades if the unpunched bottom part 2 does not melt under the influence of the delay charge as a premature detonation cannot be effected. The tubular delay charge carrier 1 with the integrated bottom part 2 is preferably made of nickel-plated brass. The disk 14 and the cup-like insert 15 can also be made of a copper-free aluminum-magnesium-silicon alloy.

It is to be understood that numerous possible variations might be made without departing from the spirit and scope of the present invention. The filling height a can, for example, be controlled in a different manner, whereby the tubular delay charge carrier is not conveyed to the punching process, in case of an insufficient filling height b. It is further possible to perforate the carrier by other means than a punch, e.g. by severing the bottom part by a radial cut.

I claim:

1. A method for producing a tubular delay charge carrier for a hand grenade fuze, said carrier being open on both sides, a detonating charge being only ignited if a delay charge is contained in said carrier, wherein a tubular delay charge carrier closed on one side by a bottom part is made, said delay charge is filled into said carrier and the filling height is measured subsequently, whereupon said bottom part of said carrier is perforated only if the filling height of said delay charge is sufficient.

2. A method according to claim 1, wherein, after filling said delay charge into said carrier, a control piston is inserted until reaching the desired filling height and a punch is arranged at said bottom part of said carrier, whereupon the distance between said control piston and said punch is reduced, depending on the actual filling height said tubular delay charge carrier thereby either being pushed onto said punch, thereby perforating said bottom part, or being further pushed onto said control piston.

* * * * *